United States Patent [19]

Wu

[11] Patent Number: 4,925,427

[45] Date of Patent: May 15, 1990

[54] CONVERTABLE TOY CAR HAVING A TWO-LEVEL CAM

[76] Inventor: Hai-Ming Wu, No. 630, An Ping Road, An Ping Chie, Tainan, 70801, Taiwan

[21] Appl. No.: 191,398

[22] Filed: May 9, 1988

[51] Int. Cl.[5] ..... A63H 17/25; A63H 17/26

[52] U.S. Cl. ..... 446/409; 446/288; 446/470

[58] Field of Search ..... 446/237, 238, 275, 277, 446/279, 280, 281, 284, 286, 288, 409, 438, 457, 462, 465

[56] References Cited

U.S. PATENT DOCUMENTS

| | | | |
|---|---|---|---|
| 3,359,680 | 12/1967 | Lindsay | 446/288 X |
| 4,083,143 | 4/1978 | Allen | 446/280 |
| 4,094,094 | 6/1978 | Ono | 446/457 X |
| 4,219,962 | 9/1980 | Dankman et al. | 446/409 |
| 4,445,297 | 5/1984 | D'Andrade et al. | 446/409 X |
| 4,717,366 | 1/1988 | Ishimoto | 446/438 X |

FOREIGN PATENT DOCUMENTS

| | | | |
|---|---|---|---|
| 2046602 | 11/1980 | United Kingdom | 446/462 |

*Primary Examiner*—Mickey Yu

*Attorney, Agent, or Firm*—Thomas S. Keaty

[57] ABSTRACT

A toy car having a two-level cam, sound assembly, projection assembly, signal light, and a signal light activation arm. The two-level cam includes an upper and a lower cam and is driven indirectly by a battery-powered electric motor and a series of gears. The upper cam drives the projection assembly to project toy figures out of the car doors and springs cause the toy figures to return to their original position. The lower cam urges a spring-loaded signal light activation arm to urge a signal light to be intermittently rotated into position. Another cam indirectly drives a reverberation arm to move and also causes two lights to move. The sound assembly includes a sound-generation device, reverberation hole, and sound emission hole, with the sound-generation device being driven directly by the motor.

1 Claim, 5 Drawing Sheets

CONVERTABLE TOY CAR HAVING A TWO-LEVEL CAM

BACKGROUND OF THE INVENTION

This invention relates to toy cars, and in particular relates to a toy car which automatically converts from a normal car to a police car in pursuit of a criminal, with policemen projecting out from the windows to fire upon the criminal. Of course, many toy cars have been manufactured and patented in the past, but none exhibited the above-mentioned automatic functions.

It is the purpose of this present invention, therefore, to provide the above-mentioned functions in the manner set forth in the detailed description of the preferred embodiment.

SUMMARY OF THE INVENTION

A primary objective of this invention is to provide a toy car which is automatically convertible from a normal car to a police car.

Another objective of this invention is to provide such a car as specified above wherein toy policemen project from the toy car after it is converted.

A further objective of this invention is to provide a car as specified above wherein appropriate sound features are coordinated with the conversion to a police car.

Futher objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
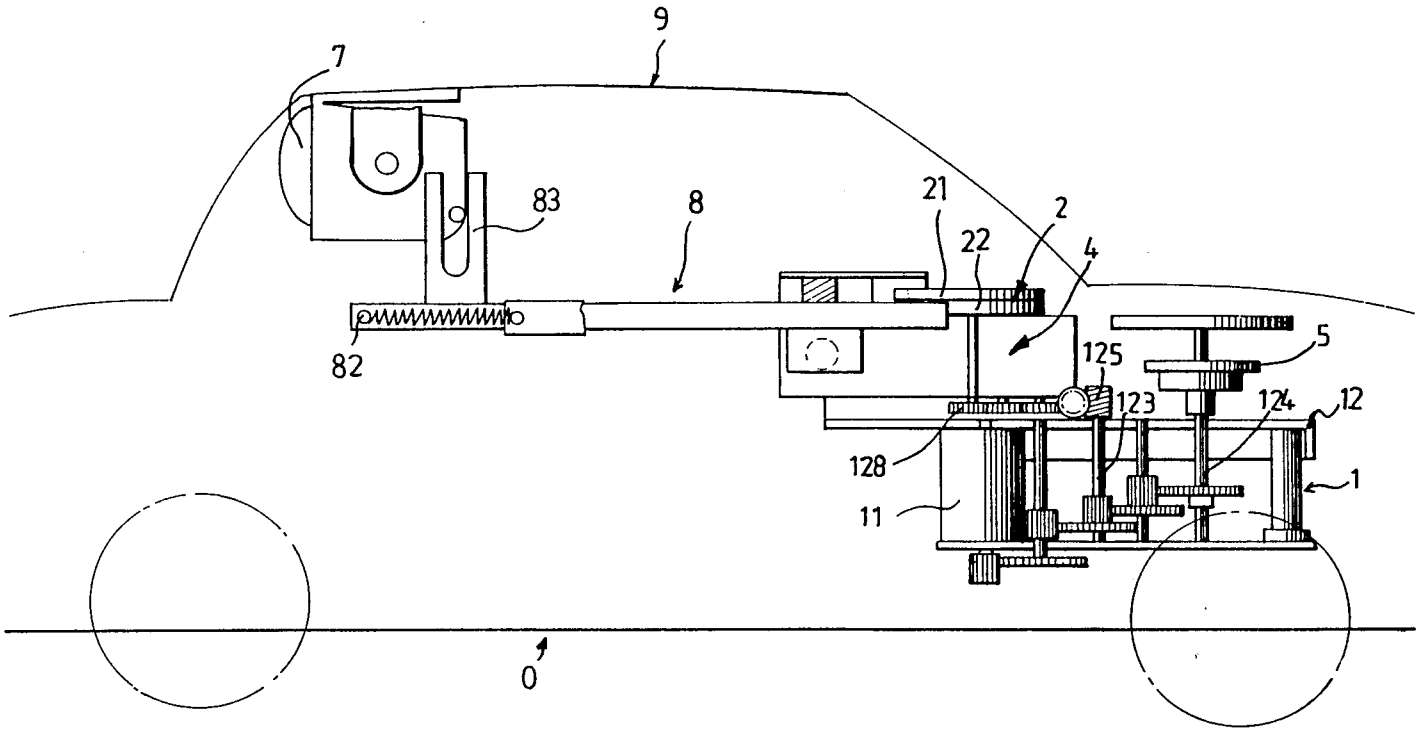
FIG. 1 is a side view of a toy car in accordance with the present invention, showing the transmission assembly, the sound assembly, the signal light activation arm, and the signal light thereof.
Figure 2:
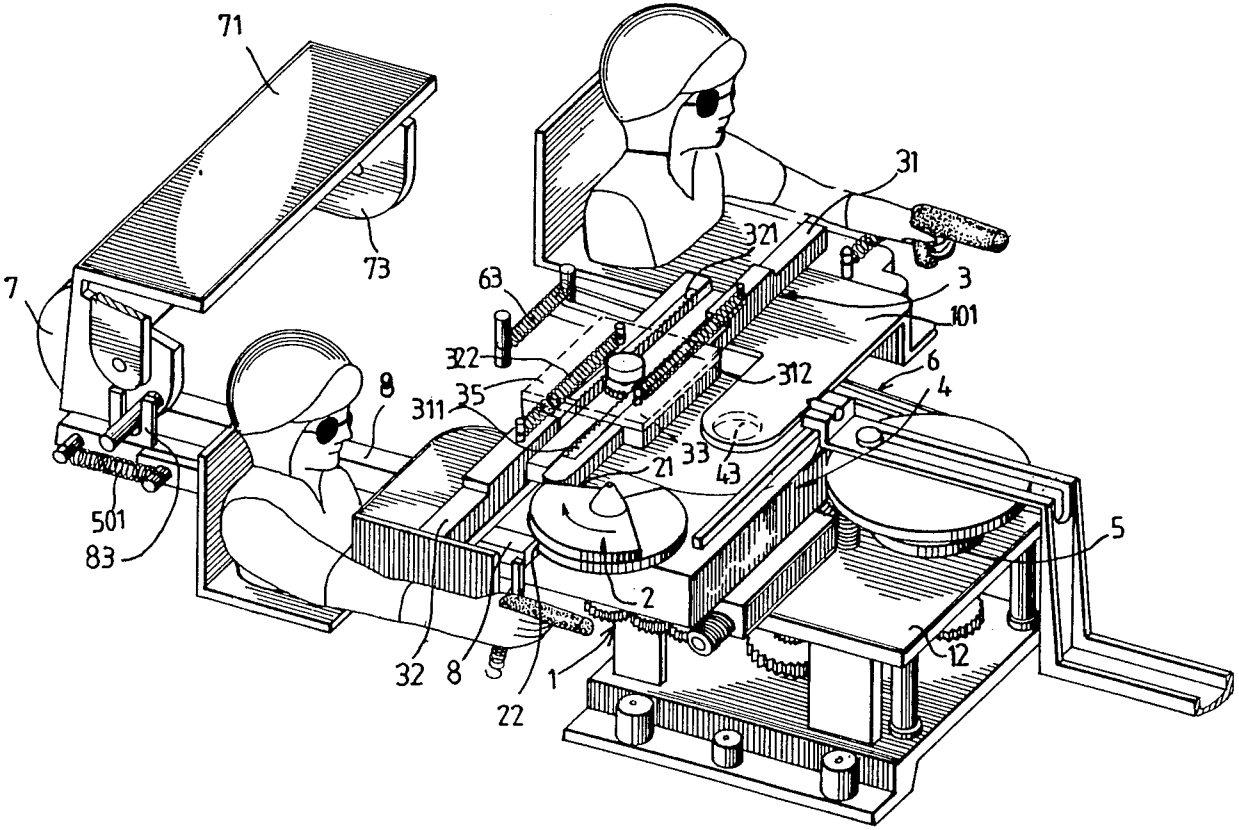
FIG. 2 is a perpective view of a toy car in accordance with the present invention, excluding the chassis and outer body thereof.

Referring to FIG. 1 and 2, it can be understood that the toy car of the present invention comprises a chassis 0, an outer body 9, a battery-driven electric motor 11 (battery not shown), a transmission assembly 1, having an outer casing 12 a sound assembly 4, a two-level cam 2, a second cam 5, a signal light activation arm 8, a signal light 7, a projection assembly 3 and a reverberation arm 6.

The projection assembly 3 is fixed on top of the sound assembly 4 and includes a left arm 31, a right arm 32 and a motion transfer gear 33. The motion transfer gear is rotatably fixed between the left and right arms 31 and 32. Each of the arms 31 and 32 have respective teeth (311 and 321) on mutually facing sides thereof which are engaged with the motion transfer gear 33 so that when the left arm 31 moves outwardly, the right arm moves outwardly, and when the left arm 31 moves inwardly, the right arm 32 moves inwardly.

The left arm 31 is alternately driven inwardly by said upper cam 22 and retracted by a spring 312. Likewise, said right arm 32 is alternately driven outwardly by said motion transfer gear 33 and retracted by a spring 322.

Figure 3:
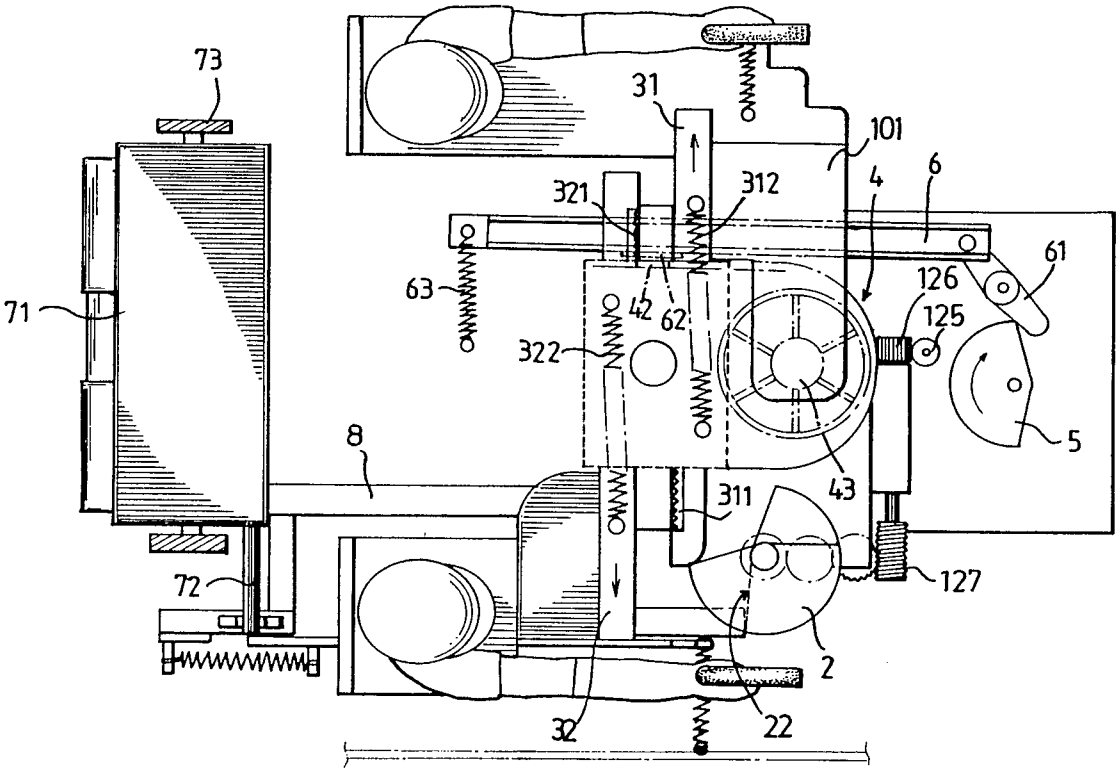
FIG. 3 is a top view of the toy car of FIG. 2, with the projection assembly in unextended position.

Now referring to FIG. 1 and 3, it can be seen that in order to provide appropriate sound effects for a police car in pursuit of a criminal, the sound assembly 4 has been provided. The sound assembly 4 is mounted on the outer casing 12 of the transmission assembly 1 and includes a reverberation hole.

Figure 4:
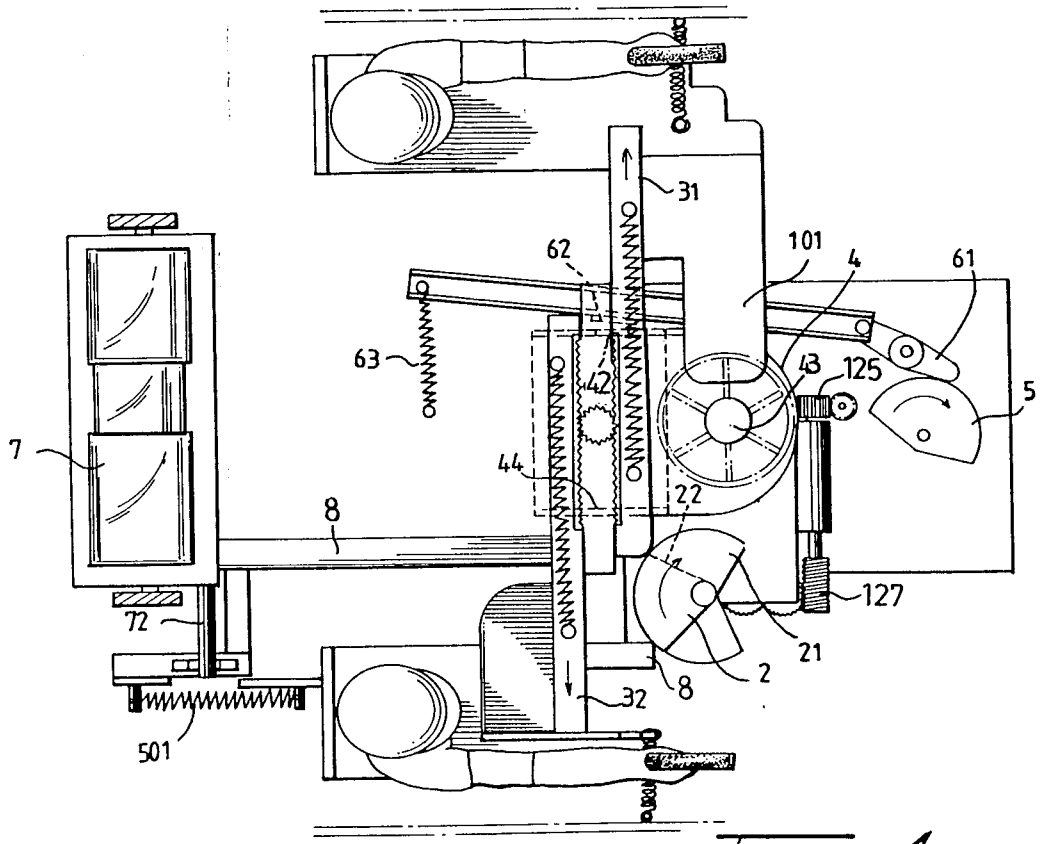
FIG. 4 is a top view of the toy car of FIG. 2, with the projection assembly in extended position.
Figure 5:
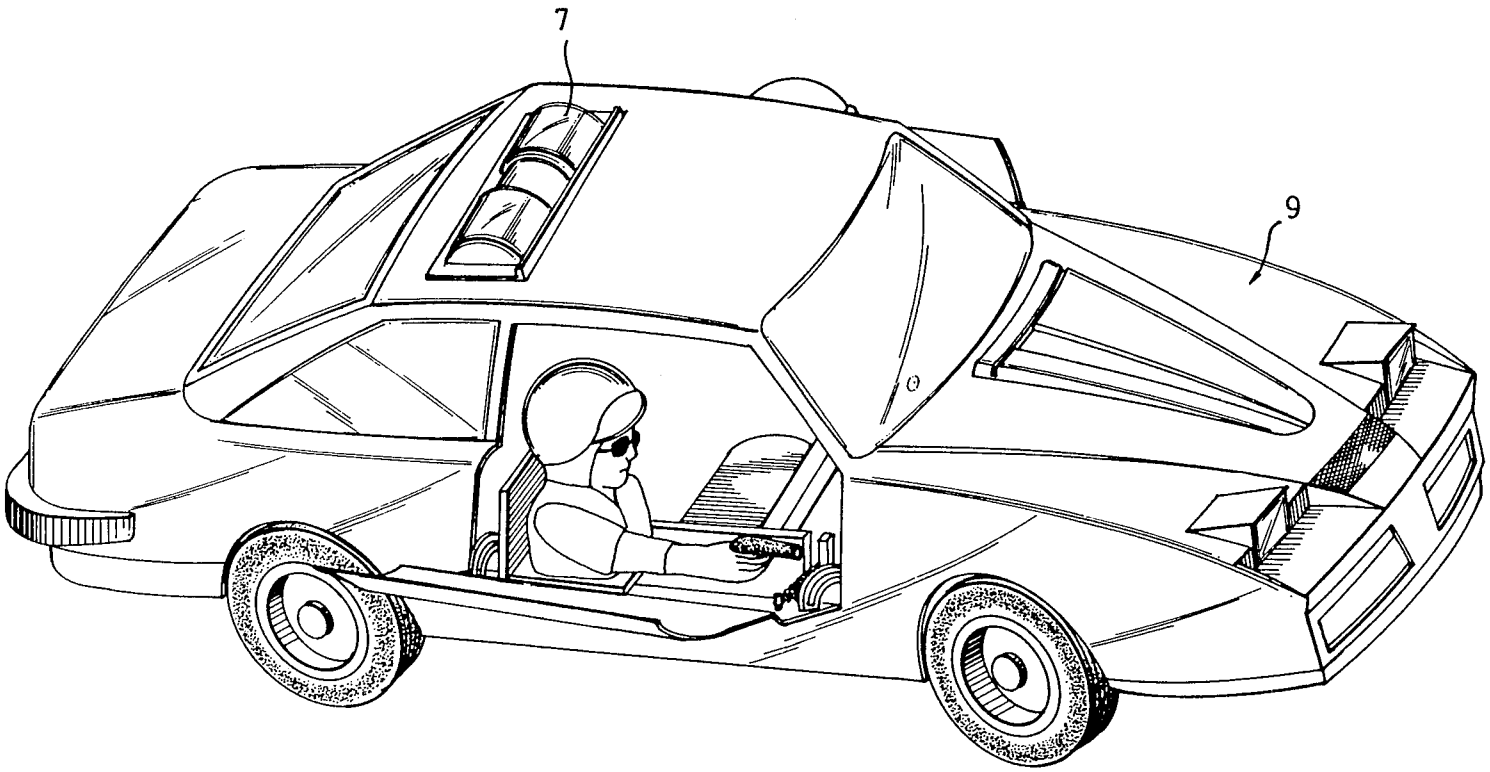
FIG. 5 is a perspective working view of a toy car in accordance with the present invention, in signal light "ON" position.

Further referring to FIG. 4, it can be seen that the two-level cam 2 is driven by a series of gears 128 which are in turn driven by a first worm gear 127. The first worm gear 127 is coaxial with another gear 126, which is driven by a second worm gear 125. The second worm gear 125 is driven by the first axle 123 of the transmission assembly, which of course is driven by the battery-driven electric motor 11.

Besides the two-level cam 2, the transmission assembly 1 also drives a second cam 5 through a second axle 124. The second cam 5 intermittently drives a lever arm 61 mounted on the outer casing (12). The lever arm (61) has a first end which is driveable by the second cam (5) and a second end attached to a second of the reverberation arm (6) for driving the reverberation arm 6 to reciprocate when the second cam 5 intermittently drives the lever arm 61.

A muffle 101 is attached to the left arm 31 and moves in the same direction synchronously as the left arm 31 moves. The muffle 101 covers the sound-emission hole 43 at its original position. The pad 62 of the reverberation arm 6 abuts against the reverberation hole 42. When the left arm 31 is actuated to move outwardly, the muffle 101 also moves outwardly and the sound-emission hole 43 is exposed. At the same time, the second cam 5 is driven thereby intermittently driving the lever arm 61 so as to actuate the reverberation arm 6. A spring 63 is attached to a second end of the reverberation arm 6 so as to prompt return of the reverberation arm 6 back to its original position and to cause the pad 62 to beat on the reverberation.

The two-level cam 2 consists of an upper cam 21 and a lower cam 22. The upper cam 21 drives the left arm 31, as can be seen best in FIG. 3. As the front edge of the upper cam 21 meets the left arm 31, it urges the left arm inward. Then, as the double-layer cam 2 continues to rotate, the outer circumference of the upper cam 21 keeps the spring-loaded projection assembly 3 in projected position, as seen best in FIG. 4. When the upper cam 21 completes its course, the left arm 31 and the right arm 32 snap back into place by the restoring force of respective springs 312 and 322.

The lower cam 22 of the two-level cam 2 intermittently drives the signal light activation arm 8 rearwardly. After each such cycle of being driven rearwardly, a spring 501 retracts the signal light activation arm 8 to its original position. The spring 501 is attached to the signal light activation arm and to the chassis 0 of the toy car. Also, the signal light activation arm 8 has a bracket 83 thereon.

A signal light 7 is pivotally fixed on the upper rear portion of the chassis 0 of the toy car. The signal light 7 has a plate-like support 71 on the length thereof which also acts as part of the roof of the toy car when the light signal 7 is not activated (or is in "OFF" position). On either end of the light signal 7 are end plates 73 which are pivotally mounted on the chassis 0. Each of the end plates 73 has a protrusion 72 thereon which is urgeable by the bracket 83 which is on the rear portion of the signal light activation arm 8. As the activation arm 8 moves rearwardly, the signal light 7 is clockwise rotated into a signal light "ON" position.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. In a toy car or the like with a chassis, outer body (9), electric motor means and transmission assembly (1) having an outer casing (12) mounted on the chassis (0), the improvement comprising:

(a) a two-level cam (2) consisting of an upper cam (21) and a lower cam (22) being driven by a series of gears (128); said series of gears (128) being driven by a first worm gear (127) which is coaxial with a gear (126); said gear (126) being driven by a second worm gear (125); said second worm gear (125) being driven by a first axle (123) of the transmission assembly (1); said transmission assembly (1) being driven by said electric motor means;

(b) a signal light activation arm (8) which alternately driven rearwardly by the lower cam (22) of said two-level cam (2) and retracted by a spring (501), said spring (501) being attached to said chassis (0); said signal light activation arm (8) having a bracket (83) thereon;

(c) a signal light (7) which is pivotally fixed on a rear portion of the chassis (0) and which has a protrusion (72) thereon which is urgeable by said bracket (83) so as to clockwise rotate said signal light (7) into a signal light "on" position;

(d) a sound assembly (4) being mounted on said outer casing (12) of said transmission assembly (1); said sound assembly (4) including a reverberation hole (42), and a sound-emission hole (43);

(e) a projection assembly (3) which is fixed on top of said sound assembly (4); said projection assembly (3) including a left arm (31), a right arm (32), and a motion transfer gear (33); said motion transfer gear (33) being rotatably fixed between said left and right arms (31 and 32) and said left arm (31) and right arm (32) having respective teeth (311 and 321) on mutually facing sides thereof engaged with said motion transfer gear (33) so that said right arm (32) moves inwardly when said left arm (31) moves inwardly and said right arm (32) moves outwardly when said left arm (31) moves outwardly; said left arm (31) being alternately driven outwardly with respect to said chassis by said upper cam (21) and retracted by a spring (312) and said right arm (32) being alternately driven outwardly by said motion transfer gear (33) and retracted by a spring (322); a muffle (101) being attached to said left arm (31) and covering said sound-emission hole (43) at its original position, said muffle (101) synchronously moving in the same direction to reveal or recover said sound-emission hole (43) as said left arm (31) moves outwardly or inwardly;

(f) a reverberation arm (6) having a pad (62) on one side thereof; said pad (62) abutting against said erverberation hole (42) of said sound assembly (4) at its original position, a first end of said reverberation arm (6) being fixed to another spring (63) mounted on said outer casing (12) for returning said pad (62) back to beat against said reverberation hole (42) in order to generate an alarm sound effect; and (g) a second cam (5) which is fixed to a second axle (124) of said transmission assembly (1); said second cam (5) intermittently driving a lever arm (61) which is pivotally attached to said outer casing (12) of said transmission assembly (1); said lever arm (61) having a first end which is driveable by said second cam (5) and a second end attached to a second end of said reverberation arm (6) for driving said reverberation arm (6) to reciprocate when said second cam (5) intermittently drives lever arm (61).

* * * * *